United States Patent [19]

Walker et al.

[11] 4,010,618

[45] Mar. 8, 1977

[54] MINE ROOF SUPPORT

[75] Inventors: John Hirst Walker, Cheltenham, England; Alan Peacock, Pittsburgh, Pa.

[73] Assignee: Dowty Mining Equipment Limited, England

[22] Filed: Sept. 2, 1975

[21] Appl. No.: 609,821

Related U.S. Application Data

[63] Continuation-in-part of Ser. No. 542,427, Jan. 20, 1975, abandoned.

[30] Foreign Application Priority Data

Jan. 19, 1974 United Kingdom ..... 2628/74

[52] U.S. Cl. ..... 61/45 D; 299/31

[51] Int. Cl.[2] ..... E21D 17/10

[58] Field of Search ..... 61/45 D; 299/31, 33; 248/57

[56] References Cited

UNITED STATES PATENTS

| | | | |
|---|---|---|---|
| 3,524,321 | 8/1970 | Wilkenloh et al. | 61/45 D |
| 3,728,863 | 9/1971 | Hidasi | 61/45 D |
| 3,830,070 | 8/1974 | Rosenberg et al. | 61/45 D |
| 3,903,703 | 9/1975 | Lubojatsky | 61/45 D |
| 3,928,981 | 12/1975 | Parker et al. | 61/45 D |

*Primary Examiner*—Jacob Shapiro
*Attorney, Agent, or Firm*—Young & Thompson

[57] ABSTRACT

This invention concerns a mine roof support of the kind comprising a floor beam, a roof engaging canopy and a plurality of extendible struts such as hydraulic jacks supporting the canopy from the floor beam. The invention comprises the provision of a flap pivotally connected along one edge of the canopy such that outward pivotal movement thereof may cause it to engage the canopy of an adjacent support. Hydraulic jack or equivalent means are provided acting between the canopy and the flap to urge the flap outwardly. The flap provides effective sealing of the gap between adjacent canopies in a line of roof supports and also enables each canopy to be positioned accurately between adjacent supports during advancing movement of the support.

23 Claims, 14 Drawing Figures

MINE ROOF SUPPORT

This application is a continuation in part of our copending application Ser. No. 542,427 filed on Jan. 20, 1975 now abandoned.

This invention relates to a mine roof support intended for use with a plurality of similar mine roof supports to form part of a longwall mining installation. A conventional mine roof support comprises a floor engaging beam, a roof engaging beam and a plurality of extendible struts supporting the roof engaging beam from the floor engaging beam. For convenience the floor engaging beam will be referred to as a floor beam and the roof engaging beam will be referred to as a canopy and the extendible struts as props. In a longwall installation, a plurality of roof supports are located in line along the mineral face, the canopies being closely spaced one from the other to provide a substantially continuous engagement with the roof along the mineral face to reduce as far as possible the falling of dust and rubble from the roof into the working space provided between the floor beams and the canopies. As the mineral is excavated from the face and conveyed away, the roof supports are advanced in sequence one at a time towards the face, each support being disengaged from the roof for this purpose. The advancing means forms no part of the present invention, but, nevertheless, in defining the roof support reference is made to the advancing direction. This is the direction in which the roof support would normally move towards the mineral face. During advancing movement of any support the lowering of the canopy from the roof disturbs rubble supported above the canopy and enables it to fall between the canopies into the working space. Also after any support has advanced and reset, its exact position of resetting relative to adjacent supports will depend on the irregularities of the roof and the floor at the position where it sets and accordingly support construction must permit some relative tipping between adjacent canopies and adjacent floor beams. It is therefore difficult to ensure that the canopies set relatively to one another so that rubble above the canopies cannot fall through between the canopies into the working space.

The object of this invention is to provide a roof support structure having sealing means operable between adjacent canopies to prevent to a considerable extent the possibility that rubble can fall through between the canopies into the working space both whilst the canopies are set against the roof and whilst a canopy advances relative to the adjacent canopy. A further object is to arrange the sealing means such that the supporting thrust exerted by the canopy against the roof does not prevent the sealing means from its operation.

The present invention further sets out to provide means for guiding each support during its advancing movement and to ensure that when reset the support is in an accurately defined position.

In accordance with the present invention, a mine roof support comprises a floor beam, a canopy having a pair of parallel opposed edges extending in the advancing direction of the support, a plurality of extendible struts acting between the floor beam and the canopy, one or more pivoted flaps provided along one said edge of the canopy whose pivotal axis or axes is or are substantially parallel to the said one edge of the canopy, and means for urging the or each flap outwardly from the canopy.

Each flap when urged outwardly from its canopy will be able under normal circumstances to make contact with the adjacent canopy to a substantial extent to prevent the possibility that rubble can fall from the roof between canopies into the working space.

The said other edge of the canopy opposite to the said one edge carrying the flap or flaps may include a fixed downwardly extending flange capable of engagement by the flap or flaps of the adjacent canopy.

The or each flap may have an outer surface provided with two lobes, each of which extends along substantially the whole length of the flap at different spacings from the pivotal axis for alternative engagement with an adjoining flat surface such for example as the surface of the flange of an adjoining roof support.

The means for urging the or each flap about its axis may comprise a hydraulic jack acting between the canopy and the flap and capable of exerting a substantially constant thrust.

The floor beam may include sliding attachment means for slidably securing to the floor beam of a similar adjacent support to permit relative movement of one support to the other in the advancing direction but to prevent relative movement between the support floor beams in a direction at right angles to the advancing direction.

The support may include link means separate from the struts and interconnecting the floor beam and the canopy to constrain relative movement between the floor beam and the canopy to that which will alter their relative spacing.

One embodiment of the invention for use in a coal mine will now be described with reference to the accompanying drawings, in which.

Figure 1:
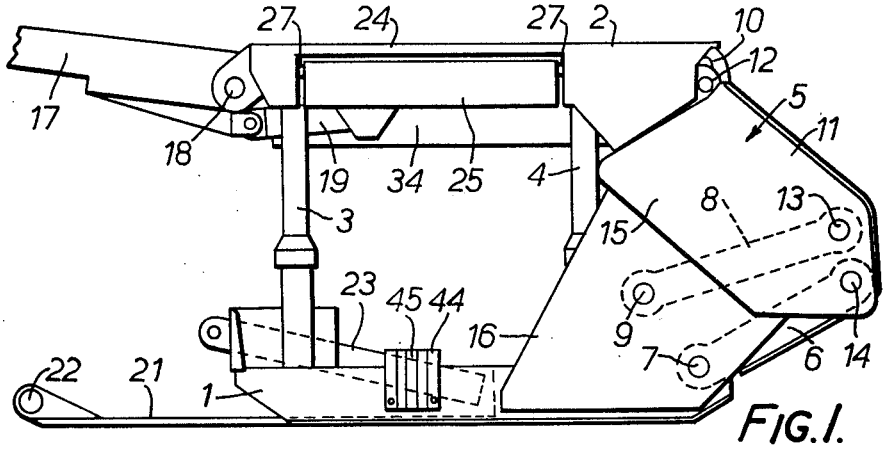
FIG. 1 is a diagrammatic elevation of a roof support incorporating the invention.

Reference is made initially to FIG. 1 of the drawings. The roof support illustrated comprises a floor beam 1, a canopy 2, hydraulically operated props 3 and 4 extending between the floor beam and the canopy and link means 5 interconnecting the floor beam and the canopy. The link means are located at the rear of the support having regard to its direction of advancement towards the coal face and incorporates a first link 6 pivotally connected at position 7 to the rear end portion of the floor beam 1, a second link 8 pivotally connected at position 9 to the rear end portion of the floor beam, a shield 11 pivotally connected at position 12 at its forward end to the canopy and at its rearward end at two positions 13 and 14 to the two links 6 and 8. The five pivotal connections 7, 9, 12, 13 and 14 have parallel axes and their relative arrangement is such that pivotal connection 12 is constrained to move in a unique path or locus which is approximately straight and approximately perpendicular to the plane of the floor beam 1. Any tendency of the canopy 2 to move in a direction which does not alter the spacing between the canopy and the floor beam, e.g. transverse movement of the canopy relative to the floor beam, will be resisted by the linkage means 5 without applying any bending moment to the props 3 and 4. The pivotal connection 12 includes a slot 10 in the canopy to permit slight tilting about an axis parallel to the advance direction. The props 3 and 4 engage the floor beam and the canopy through joints (not shown) which permit pivotal movement. Relative movement between the floor beam and the canopy which will vary the spacing between the two will be permitted by the linkage means, such movement comprising either parallel movement of the canopy towards or away from the floor beam and/or angular movement of the canopy about the pivot 12. This roof support is intended for use in deep mines where the roof is good i.e. it is not likely to break immediately adjacent to the mineral face and the main roof supporting load is exerted by the canopy at a position spaced from the mineral face.

The links 6 may be formed as a shield additionally to shield 11 to prevent entry of rubble from the rear or goaf side of the support into the working space between the canopy and the floor beam. The shield 11 is further provided with side shields 15 which move in closely spaced relation with fixed side shields 16 forming part of the floor beam. The side shields 16 may conveniently locate the two pivots 7 and 9.

The canopy 2 is provided with a forwardly extended cantilever 17 pivotally connected at position 18 to the forward end of the canopy and a hydraulic jack 19 carried by the canopy to adjust the cantilever 17 angularly about the pivot 18.

For advancing the support a relay bar 21 is slidably mounted in the floor beam 1 to extend forwardly to a connecting point 22 securable to a conventional anchorage which in this example is the conventional scraper chain conveyor which extends along the coal face underneath the cantilevers 17. An advancing jack 23 is carried by the floor beam 1 for co-operating with the relay bar 21 substantially in the manner described in application Ser. No. 514,261.

Figure 2:
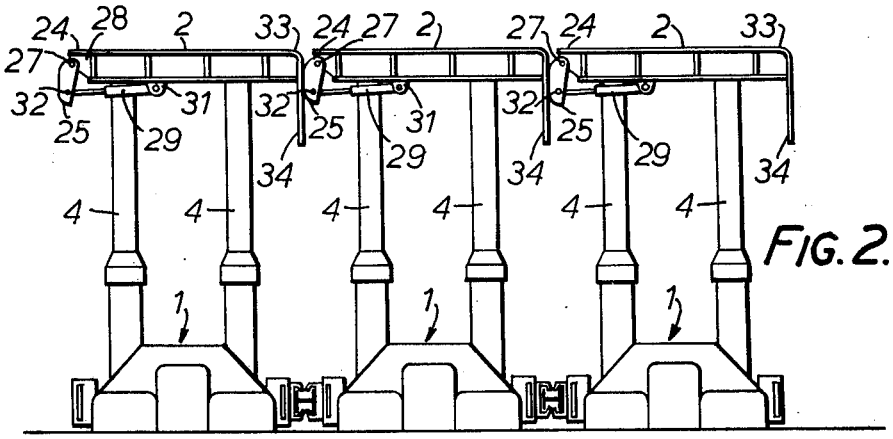
FIG. 2 is a diagrammatic end elevation of a number of roof supports in their operative position.

Reference is now also made to FIG. 2 of the accompanying drawings which shows three similar roof supports arranged side by side on a mine floor. These supports are identical with one another and similar reference numerals will be applied to similar parts in each support. One edge 24 of the canopy 2 adjacent to an adjacent canopy is provided with a pivoted flap 25 carried by pivot pins 27 located in reinforcing members 28 of the canopy, the axis of the pivot pins 27 lying substantially parallel to the edge 24. A hydraulic jack 29 is secured to the underside of the canopy 2 from mounting bracket 31 to a pivotal connection 32 with the flap. When the supports are in a roof supporting condition the jacks 29 are constantly fed with hydraulic liquid at pressure to ensure that each flap is adequately urged against the adjacent canopy to prevent debris falling through the roof between the canopies.

The edge 33 of each canopy 2 opposite to the edge 24 is provided with a fixed downwardly extending flange 34 to form an abutment for engagement by a flap 25.

Figure 3:
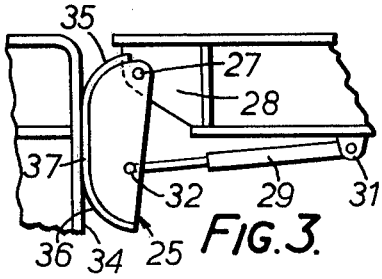
FIGS. 3, 4 and 5 are diagrammatic views showing differing positions of a flap acting between adjacent canopies.
Figure 4:
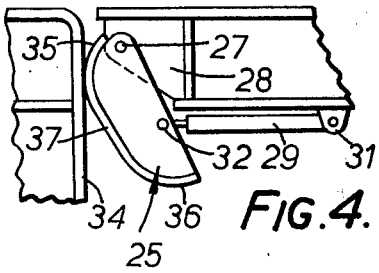
Figure 5:
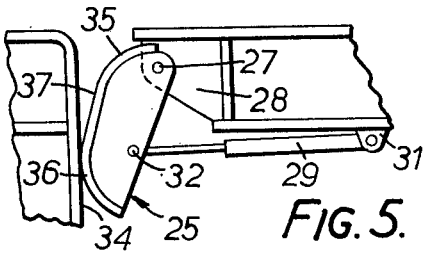

Reference is now made to FIGS. 3, 4 and 5 of the drawings to illustrate the flaps 25 in greater detail. Each flap 25 has a curved outer surface which comprises a pair of convexly curved lobes 35 and 36 and an interconnecting flat surface 37. The lobe 35 is closely adjacent to the pivot pin 27 whilst the lobe 36 is substantially spaced from the pivot 37. The lobes 35 and 36 extend the length of the flap in a direction parallel to the pivotal axis of the flap 25 about the pivots 27. FIGS. 3, 4 and 5 represent three different engagement conditions between a flap 36 and a flange 34. In FIG. 4 the spacing between the adjacent canopies 2 is less than normal and the flap 25 is retracted almost to a maximum extent whereby the lobe 35 of the flap engages the flange 34. Since the lobe 35 is close to the pivotal axis 27 the jack 29 may exert considerable leverage whereby the thrust actually exerted between adjacent canopies will be considerably greater than the thrust exerted by the jack 29. In FIG. 5 the spacing between the adjacent canopies is greater than normal so that the flap 25 is moved outwardly to engage flange 34 at the lobe 36. The resulting force which can be exerted between the two canopies will be slightly less than the thrust exerted by the jack 29 since the pivot point 32 is slightly closer to the pivot 27 than the lobe 36. FIG. 3 shows the normal spacing required between the canopies in which the flat surface 37 of the flap 25 may make surface to surface engagement with the flange 34 so that the force exerted between adjacent canopies is substantially the thrust exerted by the jack 29.

Figure 6:
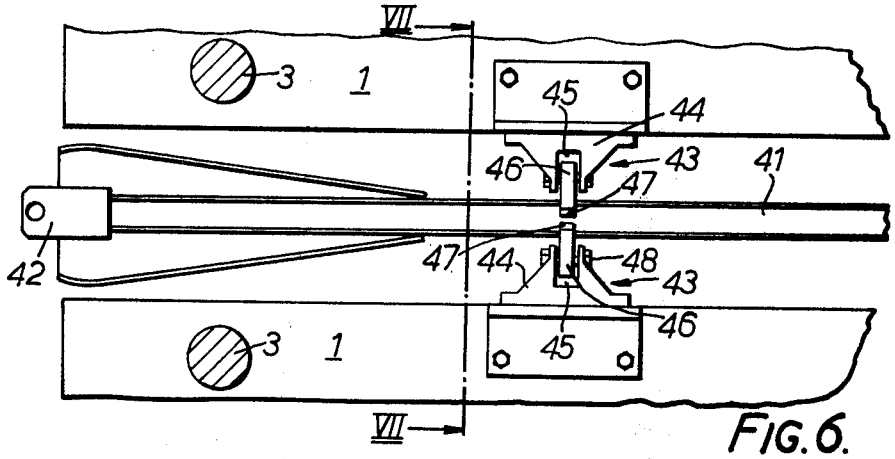
FIG. 6 is a diagrammatic plan view of the connecting means between adjacent floor beams.
Figure 7:
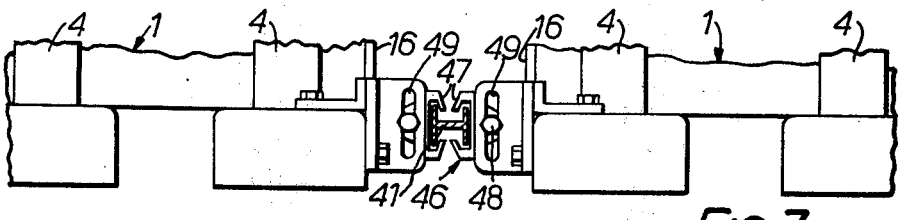
FIG. 7 is a diagrammatic cross-section taken on the line VII—VII of FIG. 6.

Reference is now made to FIGS. 6 and 7. In order to maintain a substantially constant spacing between adjacent floor beams there is provided between each pair of adjacent floor beams an attachment means comprising a beam 41 of I-section having an attachment lug 42 at its forward end for securing to the conveyor or other anchorage and a sliding engagement means 43 on each floor beam to engage slidably on the beam 41. For this purpose a bracket 44 is secured to each floor beam by bolts or the like, the bracket including a vertically disposed slot 45 which opens towards the adjacent floor beam. Within each slot 45 a fork member 46 is slidably fitted, the fork having fixed fingers 47 which engage around a flange of the I-section beam 41. Each fork 46 is slidably secured by a bolt 48 within vertical slots 49. Thus each fork 46 may slide vertically within the slot 45 and also have the ability to pivot about the axis of the bolt 48. Each fork 46 can slide along the I-section beam 41. The principal function of the whole attachment means formed by brackets 43, forks 46 and I-section beam 41 as to maintain a substantially constant spacing between adjacent floor beams whilst at the same time permitting advancing, vertical and angular movements of either floor beam relative to the other.

Figure 8:
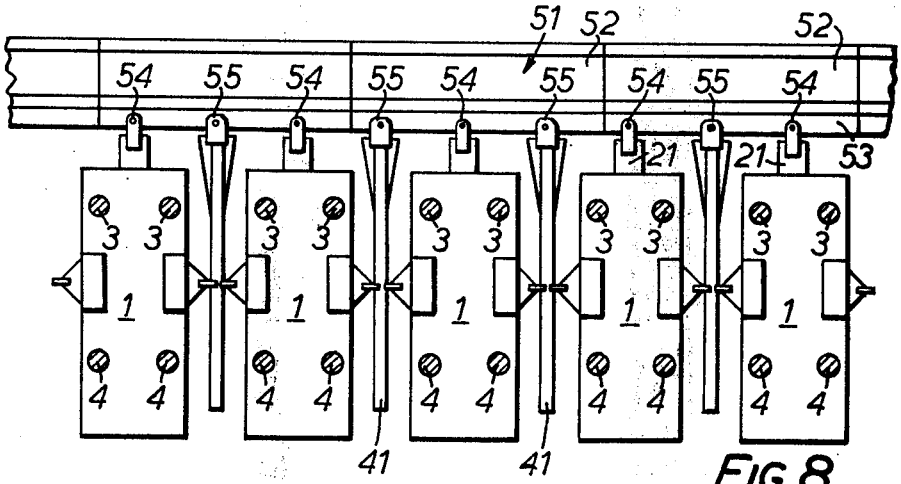
FIG. 8 is a diagrammatic plan view of the floor beams of adjacent supports in position on a mine floor.

Reference is now made to FIG. 8. The scraper chain conveyor 51 is comprised of a number of pans 52 secured in end to end arrangement with a degree of flexibility so that the conveyor may move transversely by shaking movement towards the coal face as coal is excavated. The pans include a connecting flange 53 to which are pivotally attached the relay bars 21 of the supports and the beams 41 which extend between the supports. FIG. 8 shows diagrammatically a number of floor beams 1 arranged in their normal positions relative to the conveyor 51 on the floor of a coal mine. Each of the relay bars 21 and the beams 41 are pivotally secured at fixed positions respectively 54 and 55 on the connecting flange 53. The spacings of the connections 54 and 55 will determine the relative positions of the supports along the conveyor. The supports advance one at a time, the support on either side of an advancing support being set against the roof. Thus when a support advances its floor beam is guided by the sliding engagement with the beam 41 on either side thereof in combination with the guiding effect resulting from the pulling force exerted by the relay bar on the support. Thus it is ensured that the floor beams retain a substantially constant spacing one from the other in the line of supports. Each floor beam may, however, settle in a position slightly tilted or slightly higher or lower than an adjacent floor beam due to irregularities in the mine floor. However, these slight differences in floor beam position will be accommodated by the slots 49 and bolts 48 of the attachment means between adjacent floor beams. Generally speaking the attachment means will ensure that the floor beams will remain at an approximately constant spacing one from the other and also remain approximately parallel to one another.

Figure 9:
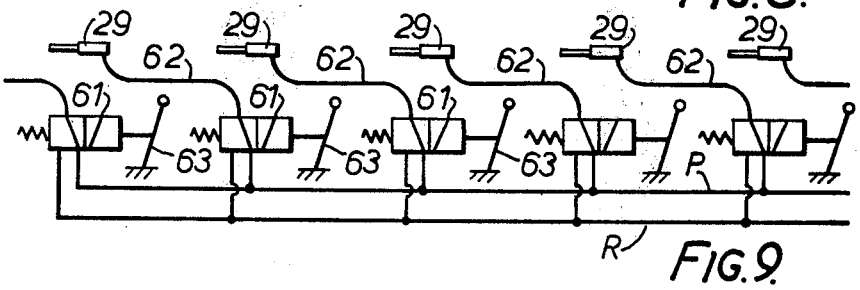
FIG. 9 is a hydraulic circuit showing the hydraulic control means for use with the flap operating jacks of the supports.

Reference is now made to FIG. 9. Each of the jacks 29 of the supports is arranged to be constantly fed with liquid at pressure from a pressure source P. Within each support there is mounted a manually operable control valve 61. Each control valve is a two position valve which is spring loaded to a normal position in which the pressure source P is connected to a flexible pipe 62 which extends to the jack 29 of the support or of the adjacent support. Each valve 61 includes a handle 63 which is movable by a miner against spring load to a second position in which the connected pipe 62 is connected to reservoir R. Thus a miner when standing under a roof support set against the roof may control the flap force acting on an adjacent support during its advancing movement.

In use a number of supports as described are arranged in a line along a mine floor adjacent to the conveyor 51 which in turn is adjacent to the coal face for receiving coal as excavated from the face. The supports and the connecting means are secured to the conveyor as illustrated in FIG. 8. All supports are retained set against the roof by conventional means not shown in this specification. Each of the jacks 29 is maintained under pressure by its connection to the pressure source and thereby each of the flaps 25 is pressed against the adjoining flange 34 thus sealing the gaps between adjacent canopies and preventing fall of rubble from the roof into the working space between the floor beams and the canopies. The miners controlling the mining operation are able to walk along the line of roof supports through the working spaces defined between the floor beams, the canopies and the hydraulic props 3 and 4 with very little possibility of being struck by a piece of rubble falling between adjacent canopies. As excavation of coal proceeds from the face the conveyor is advanced to the face and from time to time it becomes necessary for the supports to advance themselves towards the conveyor. Supports are advanced one at a time. The initial operation to advance a support is to release the support from the roof to a predetermined amount by releasing the hydraulic props 3 and 4. Then the advancing jack 23 within the support is energized to apply tension to the relay bar 21 to pull the support towards the conveyor. The conveyor is a sufficient anchor since it will be held in position by the other supports in the line on either side of the support being advanced. During the advancing movement hydraulic pressure is maintained in the jack 29 so that the flap 25 will remain in engagement with the flange 34 of its adjacent canopy. Also for the support being advanced its flange 34 will remain contacted by the flap 25 of the other adjacent canopy. The length of each flap 25 and each flange 34 is greater than the maximum single advancing movement of a support so that no flap 25 is likely to disengage from its co-operating flange 34. During the advancing movement of a support the floor beam thereof will move over the irregular mine floor and the floor beam will possibly tilt and rise or fall depending on the irregularities. However, the attachment means with the adjacent floor beams will ensure that the advancing floor beam maintains a substantially constant spacing from the adjacent floor beams. Also during the advance the canopy will be held in between the adjacent canopies by the action of the flaps 25. If for example the canopy tends to move close to one adjacent canopy and farther away from the other adjacent canopy, the engaging flaps on opposite sides will take up the positions shown in FIGS. 4 and 5 and the differential force developed will automatically restore the canopy to a normal spacing from each of the two fixed adjacent canopies. This centralising action on the canopy of an advancing support will occur without any overriding control from the miner. However, there are operating conditions when it can be essential for a miner to control the operation of the flaps during support advance such for example as where the coal seam is substantially inclined to the horizontal and the supports must necessarily stand on the floor in a position inclined to the vertical. In this case the miner can exert overriding control by operating one of the valves 61 of either of the two adjacent supports to relieve the load of the jack 29 on one or other side of the advancing support to counteract the toppling effect. Before a support is reset against the roof after its advancing movement, the miner controlling the operation will operate the valves accurately to ensure that the canopy is centralised between the two adjacent canopies. When the canopy is set to support the roof the roof supporting thrust does not in any way pass through the flap 25 and the flap is thereby able to exert its sealing effect continuously.

It will be appreciated that the automatic centralising action described for the flaps 25 will be most effective when the supports are on a substantially horizontal or slightly inclined floor. If a canopy does take up such a slight tilt as permitted by pivotal connection 10, 12, the action of the flaps 25 to centralise a canopy between adjacent fixed canopies is not adversely affected and the flat surfaces 37 of the flaps may make surface to surface engagement with flanges 34 for substantially centralising the advancing canopy.

In the first roof support described with reference to FIGS. 1 to 7, each roof support has a floor beam and four hydraulically-operated props acting as extendible struts, each of which acts directly between the floor beam and the canopy, the floor beam being made of comparatively rigid structure.

The invention may also be applied to that kind of roof support commonly called a shield support in which:

1. the floor engaging means may either be of the comparatively rigid kind of floor beam illustrated in FIGS. 1 to 7 or of the kind of floor beam comprising two elongate members which are flexibly connected together side by side and are capable of slight relative movement.

2. A caving shield mounted for pivotal movement with respect to the floor beam in a vertical plane.

3. A canopy pivotally connected to the free end portion of the caving shield, and 4. Two extendible struts each acting indirectly between the floor beam and the canopy and extending between the floor beam members and a part of the caving shield.

Figure 10:
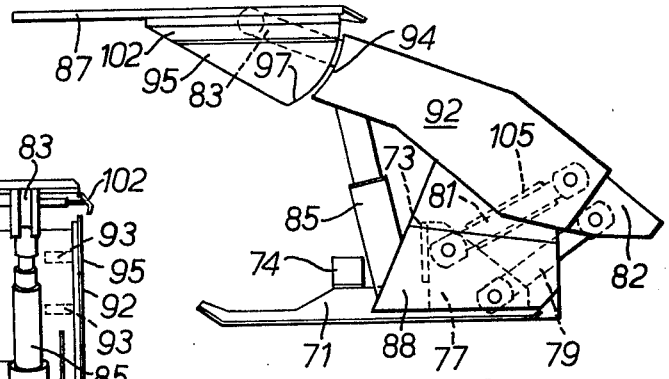
FIG. 10 is a diagrammatic side elevation of a second roof support incorporating an embodiment of the invention.
Figure 11:
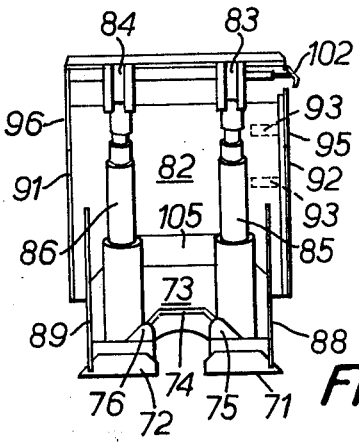
FIG. 11 is a front elevation of the support of FIG. 10.
Figure 12:
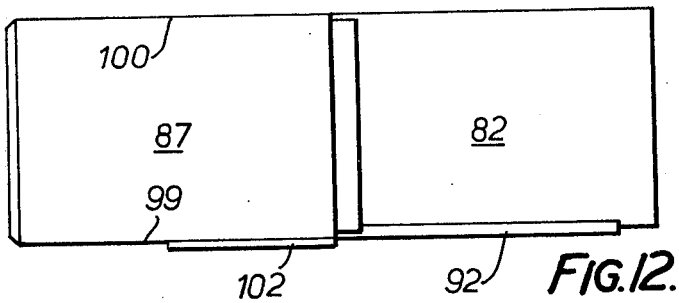
FIG. 12 is a plan view of the support of FIG. 10.

Referring now to FIGS. 10 to 13, the floor beam comprises a pair of parallel elongate members 71 and 72, flexibly held together in parallel relationship by means of a transverse metal plate 75 whose plane is substantially perpendicular to the length of the members 71 and 72 and a link 74 spaced from the plate 73 and connected to the members 71 and 72 by means of hinges 75 and 76. The arrangement is intended to allow the elements 71 and 72 to be capable of slight relative twisting movement about a transverse axis passing through the plate 73, other relative movement being substantially prevented. At the rear end of each element upwardly extending flanges 77 and 78 are formed and conveniently the front edges of flanges 77 and 78 are the means of attachment of the plate 73 to the members 71 and 72. Each set of flanges form the pivotal mountings for a pair of links of which the links 79 and 81 are shown in FIG. 10 as attached to the flanges 77 of member 71. It will be understood that a similar set of links are pivotally mounted in the flanges 78. Both pairs of links extend rearwardly and upwardly for connection to a caving shield 82 at spaced pivotal mountings. The shield 82 extends forwardly and upwardly from the links 79 and 81 terminating at its upper end at a pair of lugs 83 and 84. The axes of the pivotal connections are all parallel to one another and transverse to the advancing direction of the support. The links 79 and 81 and their pivotal connections both to the floor beam members and to the shield are so arranged that the lugs 83 and 84 are constrained during angular movement of shield 82 for movement relatively to the floor beam in a substantially straight line perpendicular to the length of the floor beam. In effect the links 79 and 81 form a pivotal mounting for the shield 82.

A pair of hydraulically-operated extendible struts 85 and 86 are provided extending between the floor beam and the shield. The strut 85 is socketed in the floor beam element 71 and the strut 86 is socketed in the floor beam element 72 and both extend in substantially parallel relation to engage in appropriate sockets in the shield 82. The socket engagements at each end of each strut permit angular movement of the struts relatively to the floor beam element and to the shield and ensure that substantially no bending moments are applied to the struts.

A roof engaging member in the form of canopy 87 is pivotally connected to the two lugs 83 and 84 and for preference a hydraulic jack is provided to act between the shield 82 and the canopy 87 for adjusting their relative angular setting. Such jack is not shown in the drawing. The canopy 87 has parallel opposed edges 99 and 100 extending in the advancing direction of the support.

Upwardly extending side screens 88 and 89 are provided at the rear end portions of the floor beam members. One side of the shield 82 carries a downwardly extending side screen 91 which externally overlaps side screen 89. The shield 82 also carries an adjustable side screen 92 which overlaps the side screen 88. The side screen 92 is carried by means of a pair of spigots 93 extending into the side of the shield 82. Any convenient means is provided for urging the side screen 92 outwardly from the shield 82 to make contact with the screen 91 of an adjacent support. The upper ends of each side screen 91 and 92 are concavely curved as at 94. The canopy is provided with a pair of side screens respectively 95 and 96 each having a convexly curved edge 97 for close fitting into the concavely curved edge 94 of side screens 92 and 91. The centre of curvature of both edges 97 and 94 lies on the axis of pivotal connection between the canopy 87 and the lugs 83 and 84. Both of the side screens 95 and 96 are fixedly secured to the canopy.

Figure 14:
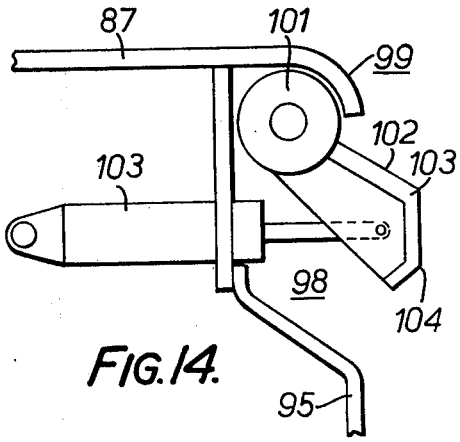
FIG. 14 is an enlarged view of part of FIG. 11.
Figure 13:
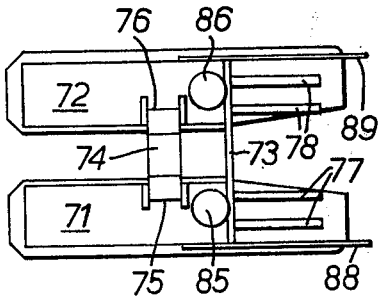
FIG. 13 is a plan view of the floor beam of FIG. 10.

The position of securement of screen 95 to the canopy 87 is shown more particularly in FIG. 14 and it will be seen that the side screen 95 is bent inwardly along its length to provide a recess 98 under the edge 99 of the canopy. Under the edge 99 a pivotal connection 101 is provided which extends part way along the canopy and carries a flap 102 which extends downwardly from the pivot 101. The flap 102 may be urged outwardly by means of a hydraulic jack 103 suitably secured under the roof beam. The flap 102 is constructed similarly to the flaps 25 of FIGS. 1 to 5 in that it possesses a pair of lobes 103 and 104 both of which extend the length of the flap in the direction parallel to the pivotal axis of the flap, the lobe 103 being more closely located relative to the pivot axis than the lobe 104. The flap 102 will provide the three engagement conditions set out in detail in FIGS. 3, 4 and 5.

A plurality of supports as shown in FIGS. 10 to 14 may be arranged in a row along a coal face, the front edges of the canopies lying close to the coal face and a coal conveyor being located on the floor underneath the canopies against the coal face. Each support will include an advancing jack which connects it to the conveyor, each advancing jack being capable of two functions, i.e. urging the conveyor towards the coal face when the support is set against the roof and of advancing the support towards the conveyor when the support is unset from the roof. When the supports are in their set positions the flap 102 of each canopy will engage against the side screen 96 of its adjacent support and will effectively seal the gap between canopies over the front end portions of the floor beams to isolate a space along which miners may walk safely. The lobes 103 and 104 of the flaps 102 will also be controlled to perform the functions described with reference to the flaps 25 of FIGS. 1 to 9. The side screens 92 of each shield will also be urged into engagement with the side screen 91 of the adjacent shield to seal the gap between shields and thus prevent entry of rubble into the space between the canopies and the floor beams. The link 81 and its parallel link extending from member 72 may be secured together by an auxiliary shield 105 of sheet metal to prevent entry of rubble through the space between the rear end of shield 82 and the rear end portions of the members 71 and 72. The auxiliary shield 105 will also provide substantial rigidity to the pivotal connection between the floor beam and the shield.

The floor beam may be made as a single rigid structure and in this instance a single hydraulically operated strut may be provided to act between the floor beam and the shield, the links 79 and 81 acting between the floor beam and the shield providing any necessary lateral rigidity to the support.

Within the broad scope of the present invention, the flaps 25 or 102 are not necessarily provided with the two lobes described and during any advancing operation of a support the canopy may be centralised in position between adjacent canopies at the end of its advancing movement purely by manual control exerted by a miner operating a control valve such as valve 61. In the described embodiments only one flap and one operating jack are provided for each canopy. However, it will be appreciated that within the scope of the invention each canopy may have two or more flaps and each flap may have two or more jacks to operate it.

We claim:

1. A mine roof support comprising a floor beam, a canopy having a pair of parallel opposed edges extending in the advancing direction of the support, a plurality of extendible struts acting between the floor beam and the canopy, one or more pivoted flaps extending along one said edge of the canopy whose pivotal axis or axes is or are substantially parallel to the said one edge of the canopy and means for urging the or each flap outwardly from the canopy.

2. A mine roof support as claimed in claim 1 including a fixed downwardly extending flange secured to the said other edge of the canopy opposite to the said one edge.

3. A mine roof support as claimed in claim 1 wherein the means for urging the or each flap about its axis comprises a hydraulic jack acting between the canopy and the flap and capable of exerting a substantially constant thrust.

4. A mine roof support as claimed in claim 1 including sliding attachment means for slidably securing the floor beam to the floor beam of an adjacent support to permit relative movement of one support to the other in the advancing direction but to prevent relative movement between the supports in a direction at right angles to the advancing direction.

5. A mine roof support as claimed in claim 2 including sliding attachment means for slidably securing the floor beam to the floor beam of an adjacent support to permit relative movement of one support to the other in the advancing direction, but to prevent relative movement between supports in a direction at right angles to the advancing direction.

6. A mine roof support as claimed in claim 1 including link means separate from the struts and interconnecting the floor beam and the canopy to prevent relative movement between the floor beam and the canopy other than that which will alter their relative spacing.

7. A mine roof support as claimed in claim 6 wherein the link means comprises a first link and a second link pivotally connected at two spaced positions to the rear end portion of the floor beam having regard to its advancing direction, a shield pivotally connected at its forward end to the canopy and at its rearward end portion connected at two spaced positions to the first and the second links, the relative arrangement of the pivot positions and the lengths of the links being such as to constrain the forward end of the shield to move substantially in a straight line perpendicular to the length of the floor beam.

8. A mine roof support as claimed in claim 1 including at least one front strut located adjacent to the front end portion of the canopy and at least one rear strut located adjacent to the rear end portion of the canopy, the said flap or flaps extending along the said one edge of the canopy between the positions of the said front and rear struts.

9. A plurality of mine roof supports each as claimed in claim 1 and arranged in a row alongside a mineral face, a hydraulic jack mounted on each canopy and acting to urge the said flap outwardly from the canopy to engage the adjacent canopy, a hydraulic supply means, a manually operable valve mounted one on each support, a connection from the hydraulic supply to each valve, a flexible connection from each valve to the hydraulic jack of the or an adjacent support, said valve means each comprising a two position device capable in one position of connecting the flexible pipe to the hydraulic supply and capable in another position of connecting the flexible pipe to a low pressure zone.

10. A mine roof support as claimed in claim 6 wherein the extendible struts extend directly between the floor beam and the canopy.

11. A mine roof support as claimed in claim 6 wherein the extendible struts extend between the floor beam and a portion of the link means.

12. A mine roof support as claimed in claim 6 wherein the link means comprises a first link and a second link pivotally connected at two spaced positions to the rear end portion of the floor beam having regard to its advancing direction, a shield pivotally connected at its forward end to the canopy and at its rearward end portion connected at two spaced positions to the first and the second links, the relative arrangement of the pivot positions and the lengths of the links being such as to constrain the forward end of the shield to move substantially in a straight line perpendicular to the plane of the floor beam.

13. A mine roof support as claimed in claim 12 wherein the extendible struts extend between the floor beam and the shield.

14. A mine roof support as claimed in claim 1 including at least one front strut located adjacent to the front end portion of the canopy and at least one rear strut located adjacent to the rear end portion of the canopy, the said flap or flaps extending along the said one edge of the canopy between the positions of said front and rear struts.

15. A mine roof support as claimed in claim 1 wherein the said flap or flaps extend along part of said one edge of the canopy lying above the forward end portion of the floor beam.

16. A mine roof support as claimed in claim 1 including a cantilever extending forwardly from a pivotal connection at the front end of the canopy, and hydraulic jack means acting between the canopy and the cantilever to adjust the angular inclination of the cantilever relative to the canopy.

17. A mine roof support as claimed in claim 13 including a pair of extendible struts acting between the floor engaging means and the shield.

18. A mine roof support as claimed in claim 17 wherein the floor beam comprises a pair of parallel floor beam members flexibly connected together, one strut extending from each floor beam member to the shield.

19. A mine roof support comprising a floor beam, a canopy having a pair of parallel opposed edges extending in the advancing direction of the support, an extendible strut acting between the floor beam and the canopy, one or more pivoted flaps extending along one said edge of the canopy whose pivotal axis or axes is or are substantially parallel to the said one edge of the canopy and means for urging the or each flap outwardly from the canopy.

20. A mine roof support as claimed in claim 19 including a fixed downwardly extending flange secured to the said other edge of the canopy opposite to the said one edge.

21. A mine roof support claimed in claim 19 wherein the means for urging the or each flap about its axis comprises a hydraulic jack acting between the canopy and the flap and capable of exerting a substantially constant thrust.

22. A mine roof support as claimed in claim 1 wherein the or each flap normally extends downwardly from its pivotal axis and the said means is arranged to move the flap angularly and upwardly about its axis.

23. A mine roof support as claimed in claim 19 wherein the or each flap normally extends downwardly from its pivotal axis and the said means is arranged to move the flap angularly and upwardly about its axis.

* * * * *